US005163509A

United States Patent [19]

Dawson

[11] Patent Number: 5,163,509

[45] Date of Patent: Nov. 17, 1992

[54] MANIFOLD ASSEMBLY AND METHOD OF MAKING SAME

[75] Inventor: Richard T. Dawson, Russellville, Ark.

[73] Assignee: Stark Manufacturing, Inc., Russellville, Ark.

[21] Appl. No.: 748,554

[22] Filed: Aug. 22, 1991

[51] Int. Cl.[5] ..... F28F 9/02

[52] U.S. Cl. ..... 165/176; 165/175; 29/890.052

[58] Field of Search ..... 29/890.052; 165/175, 165/176

[56] References Cited

U.S. PATENT DOCUMENTS

| | | | |
|---|---|---|---|
| 230,815 | 8/1880 | Puffer | 165/176 |
| 887,113 | 5/1908 | Nickel . | |
| 1,264,455 | 4/1918 | True . | |
| 1,583,758 | 5/1926 | White . | |
| 2,151,540 | 3/1939 | Varga | 29/157.4 |
| 2,260,594 | 10/1941 | Young | 165/176 |
| 2,262,627 | 11/1941 | Whitesell, Jr. et al. | 285/210 |
| 3,207,215 | 9/1965 | Whittell, Jr. | 165/134 |
| 3,411,196 | 11/1968 | Zehnder | 29/157.4 |
| 3,516,483 | 6/1970 | Benteler et al. | 165/22 |
| 3,535,909 | 10/1970 | Latham | 72/367 |
| 4,168,744 | 9/1979 | Knülle et al. | 165/154 |
| 4,211,278 | 7/1980 | Bennett et al. | 165/130 |
| 4,265,225 | 5/1981 | Berger et al. | 126/445 |
| 4,290,413 | 9/1981 | Goodman et al. | 126/426 |
| 4,381,033 | 4/1983 | Woodhull, Jr. et al. | 165/175 |
| 4,386,652 | 6/1983 | Dragojevic | 165/144 |
| 4,396,060 | 8/1983 | Schenk | 165/176 |
| 4,663,812 | 5/1987 | Clausen | 29/157.4 |
| 4,738,306 | 4/1988 | Tamba et al. | 165/173 |
| 4,749,033 | 6/1988 | Clausen | 165/173 |
| 4,770,240 | 9/1988 | Dawson et al. | 165/176 |
| 4,823,868 | 4/1989 | Neebel | 165/178 |
| 4,924,939 | 5/1990 | Kim | 165/172 |

FOREIGN PATENT DOCUMENTS

| | | | |
|---|---|---|---|
| 570156 | 8/1961 | Belgium | 129/890.052 |
| 1008330 | 5/1957 | Fed. Rep. of Germany | 165/176 |
| 2940035 | 5/1981 | Fed. Rep. of Germany | 165/176 |
| 330990 | 6/1958 | Switzerland | 165/176 |
| 2078361A | 1/1982 | United Kingdom | 165/176 |

OTHER PUBLICATIONS

Sorensen and Cleeton, Unique Manufacturing Method—Automotive Air Conditioning Condenser Manifolds, Feb.-Mar. 1989.

*Primary Examiner*—Allen J. Flanigan

*Attorney, Agent, or Firm*—Senniger, Powers, Leavitt & Roedel

[57] ABSTRACT

A manifold assembly comprising a first manifold and a second manifold. The first manifold has a first hollow conduit and a first plurality of apertures through the first conduit. The second manifold has a second hollow conduit and a second plurality of apertures through the second conduit. The manifold assembly further includes at least one joining member between the first and second manifolds for joining the first manifold to the second manifold with the first conduit being side-by-side and adjacent the second conduit. The joining member includes a region of weakness for facilitating separation of the first and second manifolds.

8 Claims, 2 Drawing Sheets

MANIFOLD ASSEMBLY AND METHOD OF MAKING SAME

BACKGROUND OF THE INVENTION

This invention relates generally to manifolds for heat exchangers and the like and, more particularly, to manifolds which mate with a plurality of tubes of a condenser or the like to supply the condenser with fluid and remove it therefrom.

Heat exchangers of the type to which the present invention pertains are commonly used in vehicle, industrial, and residential environments for heating and cooling purposes. Typically, these installations utilize a plurality of tubes to form a condenser or the like by having the fluid pass through a series of these tubes which are each generally bent in a U-shape. In order to connect these tubes together so that the fluid will flow through the series of tubes, manifolds are used which have a series of openings corresponding to and mating with the ends of the tubes. The manifolds have an inlet end and an outlet end which circulate the fluid through the heat exchanger and then return it to a remote location for subsequent recycling.

Such manifolds are typically used in pairs with one being connected to one end of all of the tubes and the other being connected to the other end of all of the tubes, and with one of them having the fluid inlet and the other having the outlet. The manifolds are either made to receive the tubes in holes or inwardly extending circular flanges formed along their lengths or are provided with tubular extensions which either receive or are received in the tubes.

The manifolds which have holes or circular flanges for receiving the tubes are typically formed of a seamless tube in which the holes are punched out and the flanges formed with a die. The manifolds having extensions are made in at least two pieces and, therefore, require seams.

There are disadvantages associated with each method of construction of these prior art devices. For example, the more seams that are needed to construct the manifold, the more likely it will be to have leaks. Also, manufacturing efficiency is substantially affected by the number of operations which have to be performed in constructing such manifolds and affixing them to the tubes of the heat exchanger.

A dual conduit manifold, disclosed in applicant's U.S. Pat. No. 4,770,240, incorporated herein by reference, solves most of the disadvantages of prior devices. However, such conduits are designed for use only where manifolds are to be used in pairs.

SUMMARY OF THE INVENTION

Among the objects of the present invention may be noted the provision of an improved manifold assembly and method of making which overcome the disadvantages and deficiencies associated with the prior art devices; the provision of such a manifold assembly and method of making in which one assembly can be used where a pair of side-by-side manifolds are needed or where a single manifold is needed; and the provision of such a manifold assembly which is of simple construction.

Generally, a manifold assembly of the present invention comprises a first manifold and a second manifold. The first manifold has a first hollow conduit and a plurality of apertures through the first conduit. The second manifold has a second hollow conduit and a second plurality of apertures through the second conduit. The manifold assembly also includes means between the first and second manifolds for joining the first manifold to the second manifold with the first conduit being side-by-side and adjacent the second conduit. The joining means includes a region of weakness for facilitating separation of the first and second manifolds.

These and other advantages will be in part apparent and in part pointed out hereinafter.

BRIEF DESCRIPTION OF THE DRAWINGS

Corresponding reference numerals indicate corresponding parts throughout the several views of the drawings.

DETAILED DESCRIPTION OF THE PREFERRED EMBODIMENT

Figure 1:
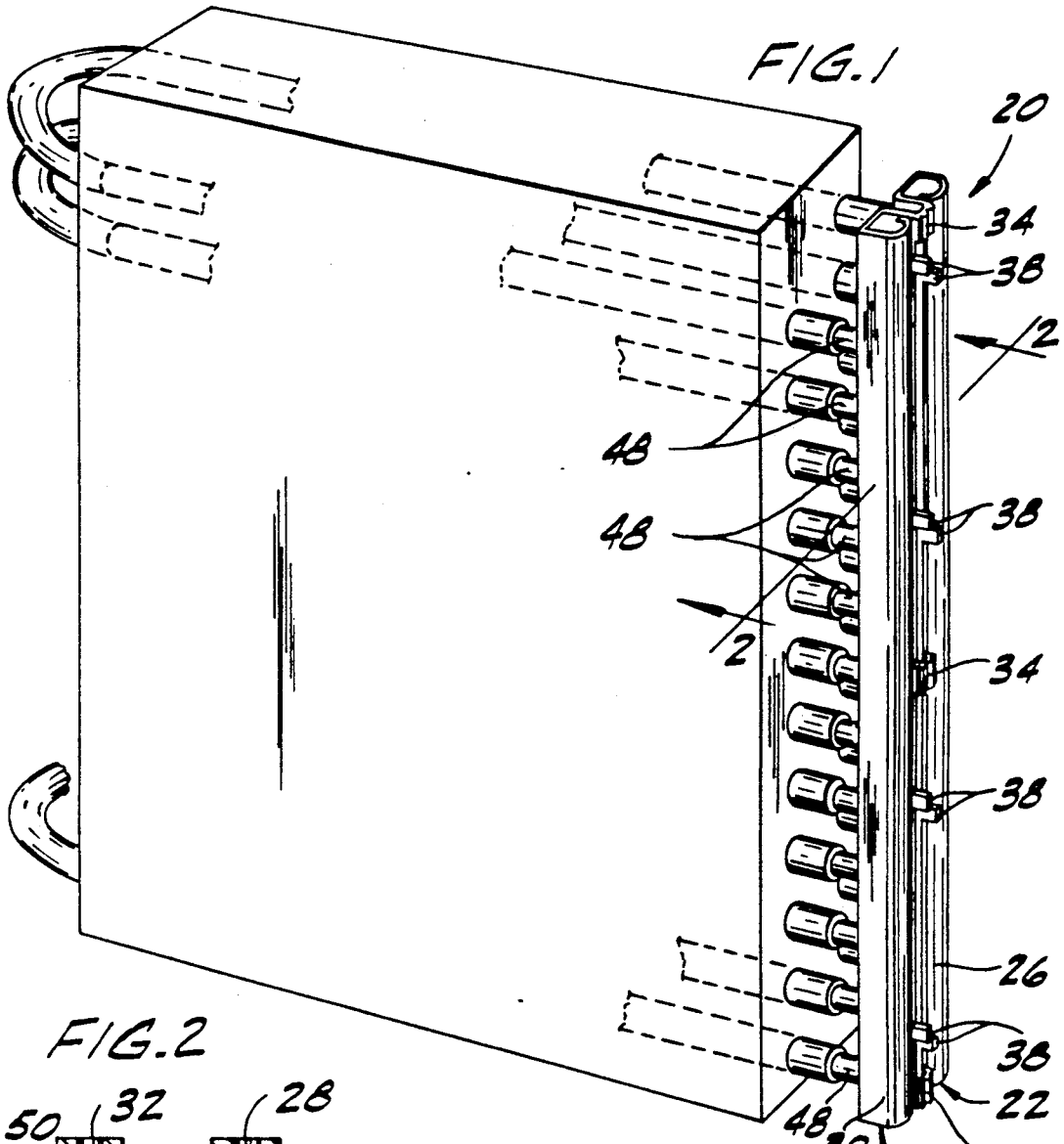
FIG. 1 is a pictorial view of a condenser showing the manifold assembly of the present invention mounted to the ends of tubes of a condenser.
Figure 2:
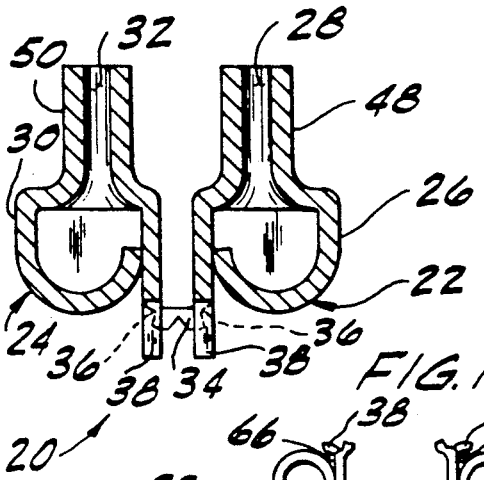
FIG. 2 is a cross-sectional view along the line 2—2 of FIG. 1 showing the manifold assembly.
Figure 3:
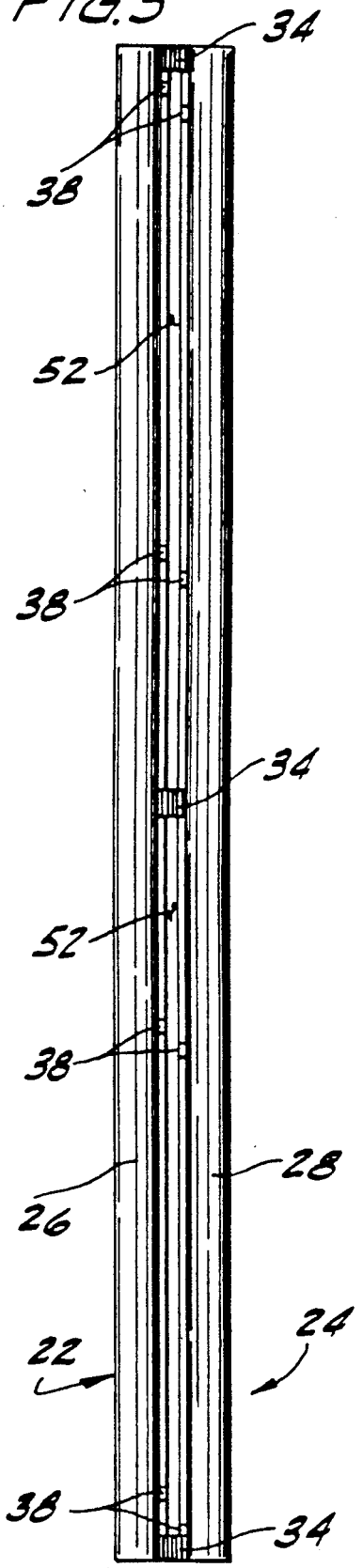
FIG. 3 is a side view of the manifold assembly.
Figure 4:
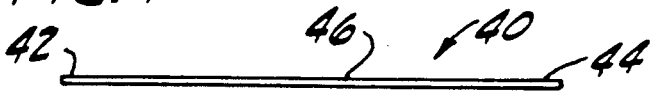

A manifold assembly constructed according to the principles of this invention is indicated generally as 20 in FIGS. 1–14. As shown in FIGS. 1–3, the manifold assembly 20 includes a first manifold, designated generally at 22, and a second manifold, designated generally at 24. The first manifold 22 has a first hollow conduit 26 and a first plurality of apertures 28 through the first conduit 26. Preferably, the first apertures 28 are spaced evenly along the length of the first conduit 26 to form a first row of apertures. The second manifold 24 has a second hollow conduit 30 and a second plurality of apertures 32 through the second conduit 30. Preferably, the second apertures 32 are spaced evenly along the length of the second conduit 30 to form a second row of apertures. The first row of apertures is generally parallel to the second row of apertures.

The first and second manifolds 22 and 24 are joined together by tabs 34 with the first conduit 26 being side-by-side and adjacent the second conduit 30. The tabs 34 constitute means for joining the first manifold 22 to the second manifold 24. The tabs 34 each include a region of weakness for facilitating separation of the first and second manifolds 22 and 24. As shown in the preferred embodiment, the regions of weakness comprise scores 36 or reduced thickness portions in the tabs 34. However, it is to be understood that regions of weakness can be formed in the tabs 34 by means other than reduced thickness portions without departing from the scope of this invention. The manifold assembly 20 further includes a plurality of protrusions 38 for retaining brazing wire or the like during brazing of seams in the conduits.

Figure 5:
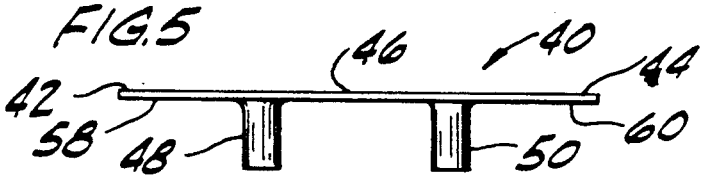

As shown in FIGS. 4–12, the manifold assembly 20 is formed from a single elongate sheet metal strip, designated generally at 40. The strip 40 has first and second elongate side edge margins 42 and 44 and an elongate intermediate region 46 generally between the first and second side edge margins 42 and 44. The strip 40 is stamped to form first and second parallel rows of tubular portions 48 and 50, as shown in FIG. 5. The tubular portions 48 and 50 are spaced at intervals along the length of the strip 40. The first row of tubular portions 48 define the first plurality of apertures 28 and the second row of tubular portions 50 define the second plurality of apertures 32. When the conduits are formed, the tubular portions 48 and 50 extend generally radially from the conduits 26 and 30.

Figure 6:
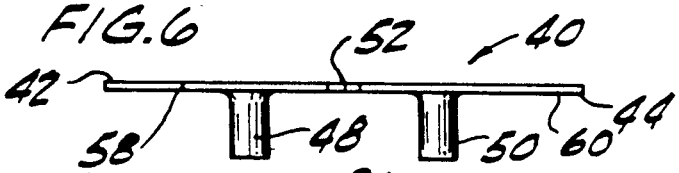
Figure 7:
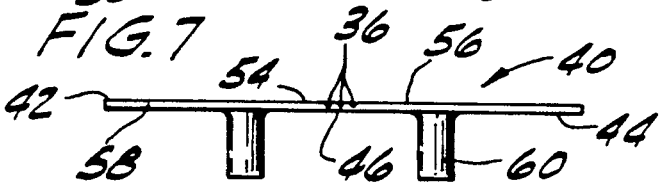

As shown in FIGS. 3 and 6, elongate slits 52, preferably two, are formed through the intermediate region 46 of the strip 40, generally midway between and parallel to the first and second side edge margins and generally lengthwise of the strip 40. One tab 34 is defined between the two slits 52 and two tabs 34 are defined between the slits 52 and the ends of the strip 40. As shown in FIG. 7, the scores 36 are formed in the tabs 34 to assist bending of the manifold assembly 20 and for creating a region of weakness in the strip 40 so that the strip can be readily parted along the intermediate region 46.

Figure 12:
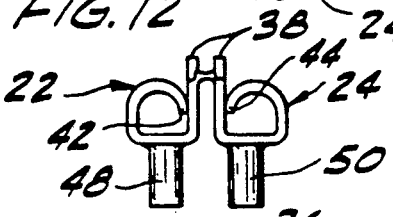
FIGS. 4–13 show the progression of steps for manufacturing the manifold assembly.
Figure 8:
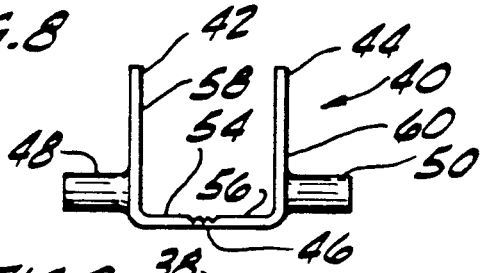
Figure 9:
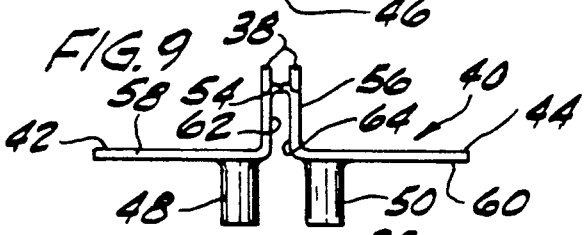
Figure 10:
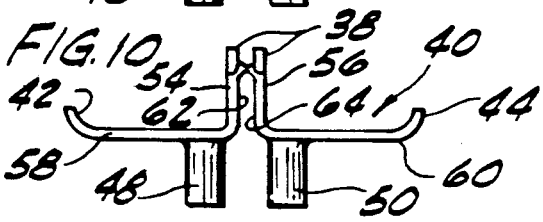
Figure 11:
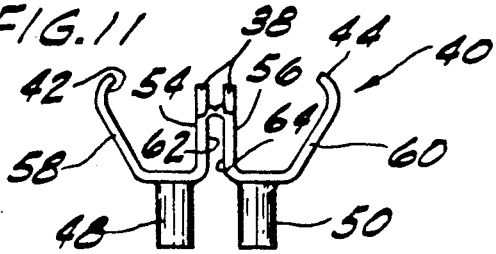

A first inner region 54 of the strip 40 is defined between the first row 48 and the intermediate region 46. A second inner region 56 of the strip 40 is defined between the second row 50 and the intermediate region 46. A first outer region 58 of the strip 40 is defined between the first row 48 and the first side edge margin 42. A second outer region 60 of the strip 40 is defined between the second row 50 and the second side edge margin 44. As shown in FIG. 8, the strip 40 is bent along its length at the first inner region 54 and bent along its length at the second inner regions 56 so that the tubular portions 48 and 50 extend outwardly in opposite directions. As shown in FIG. 9, the strip 40 is then bent at the scores 36 so that the tubular portions 48 and 50 extend downwardly in the same direction and a face 62 of the first inner region 54 is generally parallel to and closely adjacent a face 64 of the second inner region 56. The strip 40 is bent or curved along the first outer region 58 so that the first side edge margin 42 is closely adjacent the first inner region 54 to form the first conduit 26. The strip 40 is bent or curved along the second outer region 60 so that the second side edge margin 44 is closely adjacent the second inner region 56 to form the second conduit 30. The progressive steps of bending the strip 40 along the outer regions 58 and 60 is shown in FIGS. 10–12.

Figure 13:
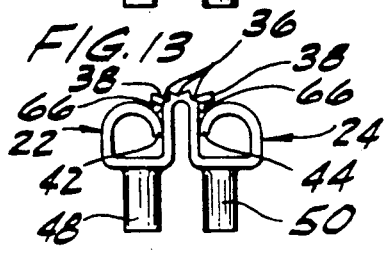

Protrusions 38 are also formed in the strip 40 at the intermediate region 46. As shown in FIG. 13, the protrusions 38 retain brazing wire 66 or the like adjacent the inner regions 54 and 56 so that the first side edge margin 42 is brazed to the first inner region 54 and the second side edge margin 44 is brazed to the second inner region 56. The brazing wire 66 is retained by bending the protrusions 38 over the brazing wire. Thus, the inner regions 54 and 56 are sealing secured to the side edge margins 42 and 44, respectively.

Figure 14:
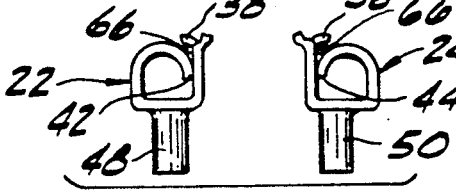
FIG. 14 shows an end view of the manifold assembly with the first manifold separated from the second manifold.

As shown in FIG. 14, the first manifold 22 can be separated from the second manifold 24 by breaking the tabs 34. Because of the scores 36, the tabs 34 are easily broken by merely bending the tabs 34 at the scores 36. If it is desired to use the manifolds 22 and 24 in pairs, the tabs 34 are not broken. If it is desired to use a single manifold, the tabs 34 are broken. Thus, two separate manifolds can be formed from a single sheet metal strip.

In view of the above, it will be seen that the several objects of the invention are achieved and other advantageous results attained.

As various changes could be made in the above constructions and methods without departing from the scope of the invention, it is intended that all matter contained in the above description or shown in the accompanying drawings shall be interpreted as illustrative and not in a limiting sense.

What is claimed is:

1. A manifold assembly comprising a first manifold having a first hollow conduit and a first plurality of apertures through said first conduit, a second manifold having a second hollow conduit and a second plurality of apertures through said second conduit, means between the first and second manifolds for joining the first manifold to the second manifold with the first conduit being side-by-side and adjacent the second conduit, said joining means comprising at least one joining portion having a region of weakness for facilitating separation of the first and second manifolds, the region of weakness comprising a reduced thickness in the joining portion.

2. A manifold assembly as set forth in claim 1 wherein said first and second manifolds are formed of a single elongate sheet metal strip.

3. A manifold assembly formed from a single elongate sheet metal strip, the strip having first and second elongate side edge margins and an elongate intermediate region generally between the first and second side edge margins, the manifold assembly comprising:

a first manifold having a first hollow conduit and a plurality of apertures through the first conduit, the first conduit being formed generally by a first conduit portion of the strip between the intermediate region and the first side edge margin, said first conduit portion being curved so that the first side edge margin is closely adjacent the intermediate region to complete the hollow form of the first conduit;

a second manifold side-by-side and adjacent the first manifold, the second manifold having a second hollow conduit and a plurality of apertures through the second conduit, the second conduit being formed generally by a second conduit portion of the strip between the intermediate region and the second side edge margin, said second conduit portion being curved so that the second side edge margin is closely adjacent the intermediate region to complete the hollow form of the second conduit; and means for facilitating separation of the first manifold from the second manifold having a region of weakness in the intermediate region, said region of weakness comprising at least one slit through the intermediate region of the strip and generally lengthwise of the strip, the slit being shorter than the length of the strip along the intermediate region to define at least one tab portion, said tab portion joining the first manifold to the second manifold.

4. A manifold assembly as set forth in claim 3 wherein the means for facilitating separation further comprises a reduced thickness portion in and extending longitudinally along the tab portion.

5. A manifold assembly as set forth in claim 4 wherein the reduced thickness portion comprises at least one score in the tab portion.

6. A manifold assembly formed from a single elongate sheet metal strip, the strip having first and second elongate side edge margins and an elongate intermediate region generally between the first and second side edge margins, the manifold assembly comprising:

a first manifold having a first hollow conduit and a plurality of apertures through the first conduit, the first conduit being formed generally by a first conduit portion of the strip between the intermediate region and the first side edge margin, said first conduit portion being curved so that the first side edge margin is closely adjacent the intermediate region to complete the hollow form of the first conduit;

a second manifold side-by-side and adjacent the first manifold, the second manifold having a second hollow conduit and a plurality of apertures through the second conduit, the second conduit being formed generally by a second conduit portion of the strip between the intermediate region and the second side edge margin, said second conduit portion being curved so that the second side edge margin is closely adjacent the intermediate region to complete the hollow form of the second conduit; and means for facilitating separation of the first manifold from the second manifold comprising a reduced thickness portion in the intermediate region extending longitudinally along at least a portion of the length of the strip.

7. A manifold assembly formed from a single elongate sheet metal strip, the strip having first and second side edge margins and an intermediate region generally between the first and second side edge margins, the manifold assembly comprising:

a first manifold having a first hollow conduit and a first row of tubular portions extending generally radially from the first conduit, the tubular portions of the first row being spaced at intervals along the length of the first conduit with each of the tubular portions of the first row being in communication with the interior of the first conduit, the first conduit being formed generally by a portion of the strip between the intermediate region and the first side edge margin, a first inner region of the strip being defined between the intermediate region and the first row of tubular portions, a first outer region of the strip being defined between the first row of tubular portions and the first side edge margin, the first inner region of the strip and the first outer region of the strip constituting the first conduit, at least one of said first inner region and said first outer region being curved so that the first side edge margin is closely adjacent the first inner region to complete the hollow form of the first conduit;

a second manifold side-by-side and adjacent the first manifold, the second manifold having a second hollow conduit and a second row of tubular portions extending generally radially from the second conduit, the tubular portions of the second row being spaced at intervals along the length of the second conduit with each of the tubular portions of the second row being in communication with the interior of the second conduit, the second conduit being formed generally by a portion of the strip between the intermediate region and the second side edge margin, a second inner region of the strip being defined between the intermediate region and the second row of tubular portions, a second outer region of the strip being defined between the second row of tubular portions and the second side edge margin, the second inner region of the strip and the second outer region of the strip constituting the second conduit, at least one of said second inner region and said second outer region being curved so that the second side edge margin is closely adjacent the second inner region to complete the hollow form of the second conduit; and means for facilitating separation of the first manifold from the second manifold comprising a reduced thickness portion in the intermediate region extending longitudinally along at least a portion of the length of the strip to provide a region of weakness in the intermediate region.

8. A manifold assembly comprising a first manifold having a first hollow conduit and a first plurality of apertures through said first conduit, a second manifold having a second hollow conduit and a second plurality of apertures through said second conduit, a joining portion between the first and second manifolds for joining the first manifold to the second manifold with the first conduit being side-by-side and adjacent the second conduit, at least one slit through the joining portion, the slit being shorter than the length of the joining portion to define at least one tab portion, said tab portion joining the first manifold to the second manifold, said slit causing a weakness of the joining portion for facilitating separation of the first and second manifolds.

* * * * *